US011598492B1

(12) United States Patent
Wang

(10) Patent No.: US 11,598,492 B1
(45) Date of Patent: Mar. 7, 2023

(54) LED LAMP WITH IMPROVED LAMP HOLDER STRUCTURE

(71) Applicant: DONGGUAN HUIHUAN LIGHTING CO., LTD., Dongguan (CN)

(72) Inventor: Song Wang, Chengdu (CN)

(73) Assignee: DONGGUAN HUIHUAN LIGHTING CO., LTD., Dongguan (CN)

( * ) Notice: Subject to any disclaimer, the term of this patent is extended or adjusted under 35 U.S.C. 154(b) by 0 days.

(21) Appl. No.: 17/709,399

(22) Filed: Mar. 30, 2022

(30) Foreign Application Priority Data

Mar. 18, 2022 (CN) ..... 202220598448.8

(51) Int. Cl.

| | |
|---|---|
| ***F21K 9/235*** | (2016.01) |
| ***F21K 9/232*** | (2016.01) |
| ***F21S 4/28*** | (2016.01) |
| ***F21V 23/06*** | (2006.01) |
| ***F21V 19/00*** | (2006.01) |
| *F21Y 115/10* | (2016.01) |

(52) U.S. Cl.
CPC ..... *F21K 9/235* (2016.08); *F21K 9/232* (2016.08); *F21S 4/28* (2016.01); *F21V 19/0025* (2013.01); *F21V 23/06* (2013.01); *F21Y 2115/10* (2016.08)

(58) Field of Classification Search
CPC ..... F21K 9/232; F21K 9/235; F21S 4/28
See application file for complete search history.

(56) References Cited

U.S. PATENT DOCUMENTS

| | | | | |
|---|---|---|---|---|
| 11,320,129 | B1 * | 5/2022 | Colby | F21K 9/65 |
| 2015/0085489 | A1 * | 3/2015 | Anderson | F21K 9/23 313/643 |
| 2016/0369949 | A1 * | 12/2016 | Wu | F21K 9/235 |
| 2017/0122531 | A1 * | 5/2017 | Li | F21V 23/001 |
| 2018/0045380 | A1 * | 2/2018 | Li | F21V 3/02 |
| 2018/0066812 | A1 * | 3/2018 | Fan | F21V 3/061 |
| 2021/0388952 | A1 * | 12/2021 | Wan | F21K 9/66 |

* cited by examiner

*Primary Examiner* — Jong-Suk (James) Lee
*Assistant Examiner* — Christopher E Dunay

(57) ABSTRACT

The present invention relates to the field of lamp technologies, and in particular to an LED lamp with improved lamp holder structure. The LED lamp includes an LED lamp holder, a stem assembly connected to the LED lamp holder and an outer bulb shell. The LED lamp holder is connected to a rubber base. A ring-shaped connecting part A is set on the rubber base. A ring-shaped connecting part B is set on the outer bulb shell. The ring-shaped connecting part A is fixedly connected to the ring-shaped connecting part B. The LED lamp features the following advantages: 1, an improved lamp holder structure adopts a small lamp holder to connect a large bulb shell, so that manufacturing cost of products is effectively reduced; 2, the rubber base is set on the lamp holder and can be directly connected to the outer bulb shell, so that production efficiency is improved.

8 Claims, 8 Drawing Sheets

LED LAMP WITH IMPROVED LAMP HOLDER STRUCTURE

TECHNICAL FIELD

The present invention relates to the field of lamp technologies, and in particular, to a lamp with improved lamp socket structure.

BACKGROUND ART

With the popularization of electric power, lamps have been used in thousands of households. People are no longer limited to using lamps for general lighting, but also tend to use lamps to create different atmospheres. For example, at outdoor entertainment places such as a family gathering, a party or the like, lamps are used to heighten a party atmosphere, improve the interest and the artistic effect, etc.

To meet illumination and decoration effects, a lamp bulb applied to a gathering place is generally a large lamp bulb with a specification of E26. However, large lamp holder with the specification of E26 and cables with cable diameters of xxx need to be mated as a result of large power during a manufacturing process of an existing E26 lamp bulb. More raw materials are required, so that production cost is high. In the prior art, lamp holder is generally reduced to save the raw materials. However, the small lamp holder only can be connected to a smaller bulb shell. The mouth part of large bulb shell formed by an existing blow molding process cannot be reduced to mount on the small lamp holder. The thickness is difficult to control during the producing and manufacturing process, so severe thickness imbalance for bulb shell may occur in a barely-molded large bulb shell to affect structural strength, light transmission, and the like. In view of this, the inventor proposes an invention.

Technical Solution of the Invention

To overcome the shortcomings in the prior art, the present invention provides an LED lamp with improved lamp holder structure. The LED lamp features low manufacturing cost and high efficiency.

To achieve the objective, the present invention discloses an LED lamp with improved lamp holder structure. The LED lamp includes an LED lamp bulb. The LED lamp bulb includes an LED lamp holder, a stem assembly and a plastic formed outer bulb shell. The stem assembly is connected to the LED lamp holder and extends into the outer bulb shell. The LED lamp holder is connected to a rubber base, a ring-shaped connecting part A is set on the rubber base, a ring-shaped connecting part B is set on the outer bulb shell, and the ring-shaped connecting part A is fixedly connected to the ring-shaped connecting part B.

Further, the ring-shaped connecting part A is a ring-shaped protrusion part. The ring-shaped connecting part B is a ring-shaped platform part set inside the opening end of the outer bulb shell. The ring-shaped protrusion part may abut against the ring-shaped platform part.

Preferably, a connecting slot is set in the ring-shaped connecting part A. The ring-shaped connecting part B is a ring-shaped protrusion part set outside the opening end of the outer bulb shell. The ring-shaped protrusion part is adaptive to the connecting slot.

Preferably, the rubber base is integrally formed with an inner bulb shell, the inner bulb shell is embedded into the outer bulb shell, and the stem assembly extends into the inner bulb shell.

Further, the stem assembly includes a first metal support line, an LED light bar and a second metal support line which are electrically connected in sequence. The first metal support line includes a resistor A. Both the first metal support line and the second metal support line are electrically connected to the LED lamp holder.

Preferably, the second metal support line includes a resistor B. One end of the resistor B is electrically connected to the first metal support line, and the other end of the resistor B is electrically connected to the LED lamp holder.

Further, the stem assembly further includes a sealing rubber base with an elastic waterproof sealing effect. The sealing rubber base is in sealing close fit to the inner side of a mouth part of the rubber base. At least two sealing holes for accommodating the resistor A and the resistor 13 are set in the sealing rubber base.

Further, the opening ends of the sealing holes are positioned inside the mouth part of the rubber base. Bottoms of the sealing holes are set inside the mouth part of the rubber base, or Further, the opening ends of the sealing holes are positioned outside the mouth part of the rubber base. Bottoms of the sealing holes are positioned inside the mouth part of the rubber base.

Preferably, the sealing rubber base includes a cylindrical part for water-preventing and sealing. The upper part of the cylindrical part is connected to a supporting part, and a flange is set on the lower part of the cylindrical part.

Preferably, a groove is set in the outer end surface of the sealing rubber base. The groove is perpendicular to axes of the sealing holes. At least a part of section areas of the sealing holes is correspondingly overlapped in the groove.

The beneficial effects: compared with the prior art, the LED lamp with improved lamp holder structure provided in the present invention includes an LE) lamp bulb. The LED lamp bulb includes an LED lamp holder, an outer bulb shell and a stem assembly. The stem assembly is connected to the LED lamp holder and extends into the outer bulb shell. A rubber base is set on the LED lamp holder. A ring-shaped connecting part A is set on the rubber base, a ring-shaped connecting part B is set on the outer bulb shell, and the ring-shaped connecting part A is fixedly connected to the ring-shaped connecting part B. The present invention features the following advantages: Firstly, the improved lamp holder structure adopts a small lamp holder to connect to a large bulb shell, so that manufacturing cost of products can be reduced; secondly, the rubber base is set on the lamp holder, and the rubber base can be directly connected to the outer bulb shell, so that production efficiency is improved.

REFERENCE NUMERALS

Figure 1:
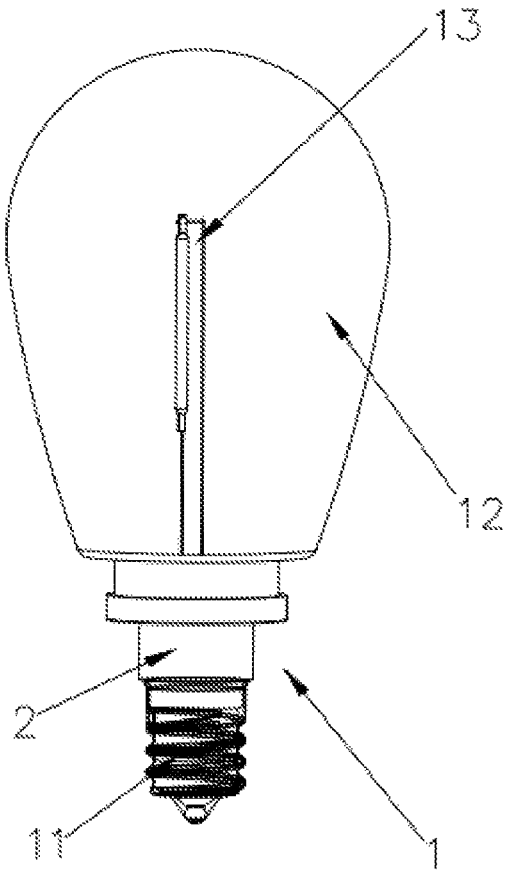
FIG. 1 is a schematic perspective view of the present invention.
Figure 2:
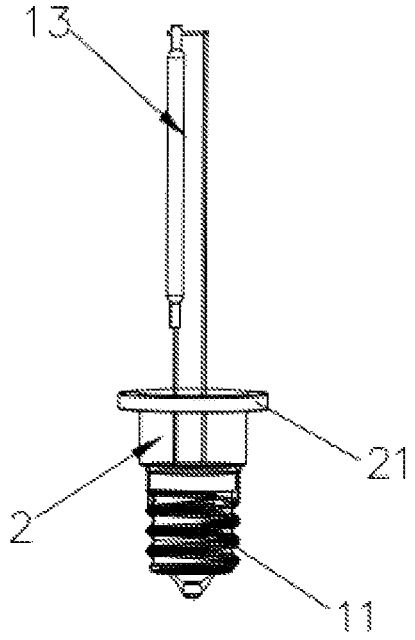
FIG. 2 is a schematic diagram of the structure of an LED lamp bulb of the present invention.
Figure 3:
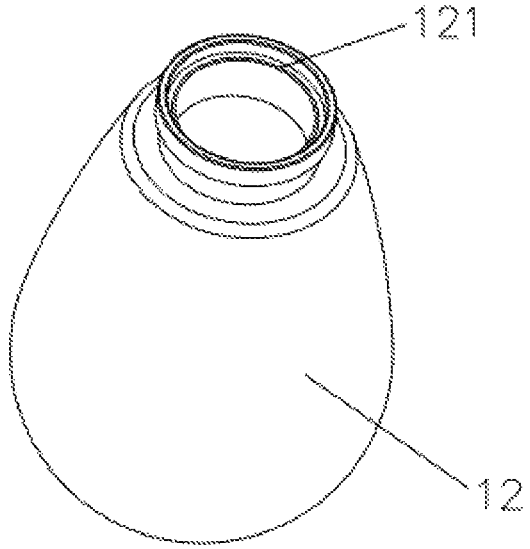
FIG. 3 is a schematic diagram of the structure of an outer bulb shell of the present invention.

1, LED lamp bulb; 11, LED lamp holder; 12, outer bulb shell; 121, ring-shaped connecting part B; 13, stem assembly; 131, first metal support line; 1311, resistor A; 132, LED light bar; 133, second metal support line; 1331, resistor B; 2, rubber base; 21, ring-shaped connecting part A; 22, connecting slot; 23, inner bulb shell; 3, sealing rubber base; 31, sealing hole; 32, cylindrical part; 33, supporting part; 34, flange; 35, groove; 36, raised bar; 37, jack: and 38, supporting column.

DETAILED DESCRIPTION

The present invention will be described in detail in conjunction with FIG. 1 to FIG. 13.

The present invention discloses an LED Lamp with improved lamp holder structure. The LED lamp includes an LED lamp bulb 1. The LED lamp bulb 1 includes an LED lamp holder 11, a stem assembly 13 and a plastic formed outer bulb shell 12. The stem assembly 13 is connected to the LED lamp holder 11 and extends into the outer bulb shell 12. The LED lamp holder 11 is connected to a rubber base 2, a ring-shaped connecting part A 21 is set on the rubber base 2, a ring-shaped connecting part B 121 is set on the outer bulb shell 12, and the ring-shaped connecting part A21 is fixedly connected to the ring-shaped connecting part 13121. In the prior art, during manufacturing of an E26 lamp bulb, an E12 lamp holder 11 is generally mated to the E26 lamp bulb to reduce the production cost. However, a mouth part diameter of the E26 lamp bulb shell produced and formed through existing blow molding process is generally about 2.640 cm, and the diameter of the bulb shell is about 6.60 cm, so the mouth part cannot be further reduced to match with a smaller lamp holder, failing short of meeting use standards of products. Therefore, the outer bulb shell 12 only can be connected to a lamp holder socket on the cable to result in problems such as complex mounting, low efficiency, high transportation cost and the like. To overcome the problems, the rubber base 2 is set on the lamp holder 11, the ring-shaped connecting part A21 is set on the rubber base 2, and the ring-shaped connecting part A21 is connected to the ring-shaped connecting pail B121 on the outer bulb shell 12. In this way, the LED lamp bulb 11 is directly connected to the outer bulb shell 12 to overcome the problems in forming a large bulb shell and a small mouth part through the prior-art process. The assembly is convenient, so that the lamp bulb production efficiency is greatly improved. In addition, this small lamp holder saves raw materials, reduces the production cost, and simplifies a lamp bulb structure. The LED lamp is packaged to transport after being formed, so that transportation efficiency is improved, and the transportation cost is reduced As an embodiment, refer to FIG. 2 and FIG. 3, in this embodiment, the ring-shaped connecting part A21 is a ring-shaped protrusion part. The ring-shaped connecting part 13121 is a ring-shaped platform part set inside the opening end of the outer bulb shell 12. The ring-shaped protrusion part may abut against the ring-shaped platform part. The ring-shaped protrusion part and the ring-shaped platform part which abut against each other may directly block the ring-shaped protrusion part through the opening end of the outer bulb shell 12. To be specific, the outer bulb shell 12 and the rubber base 2 are directly connected by clamping, so that the effect of quickly assembling the lamp holder 11 and the outer bulb shell 12 is achieved. The structure is simple and quick to assemble. To further optimize the technical scheme and improve connection stability, an ultrasonic welding manner or a bonding manner may be further adopted for connection, so that the use is convenient, the effect is more stable, phenomena such as drop due to unstable connection are avoided, and the yield is increased.

Figure 4:
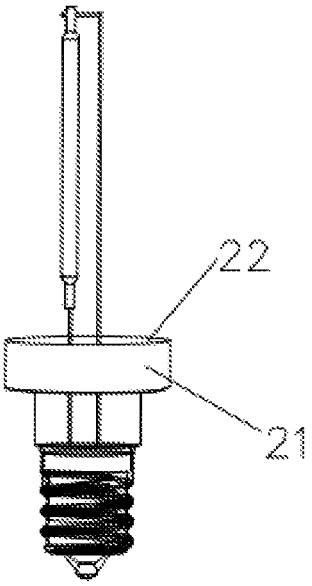
FIG. 4 is a schematic diagram of the structure of a ring-shaped connecting part Ain another embodiment of the present invention.
Figure 5:
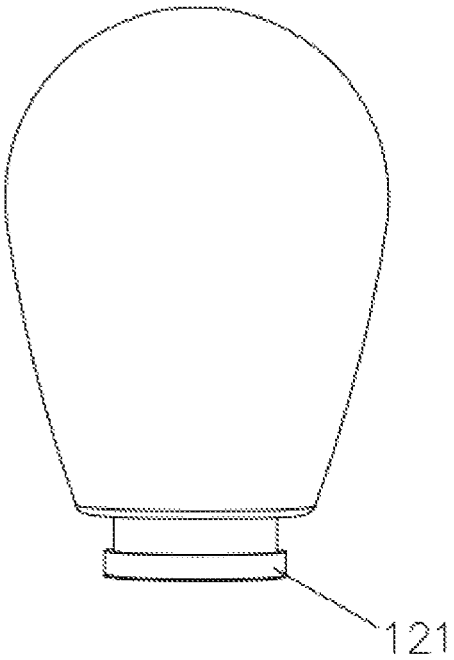
FIG. 5 is a schematic diagram of the structure of a ring-shaped connecting part B in another embodiment of the present invention.
Figure 6:
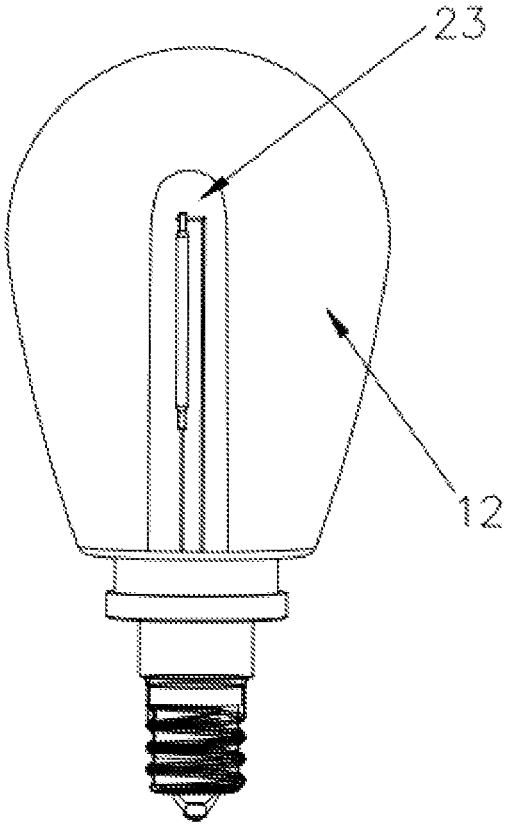
FIG. 6 is a schematic diagram of the structure of an inner bulb shell of the present invention
Figure 7:
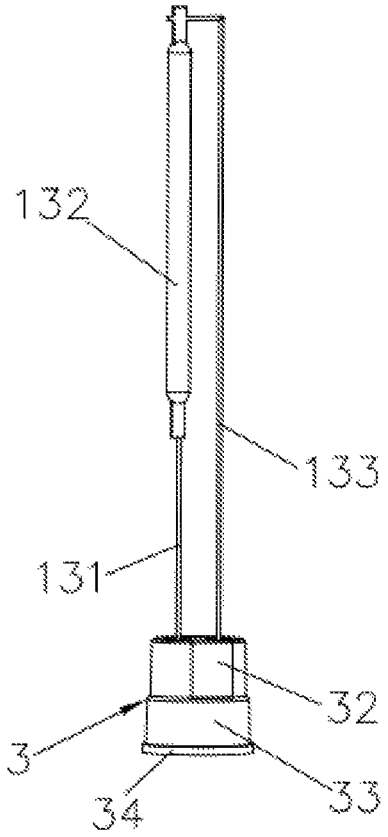
FIG. 7 is a structural diagram of the structure of a stem assembly of the present invention.
Figure 8:
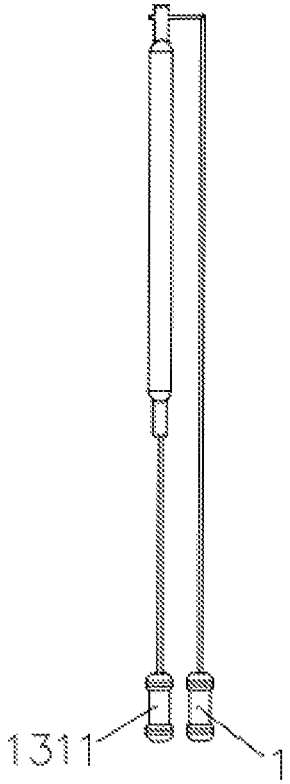
FIG. 8 is a structural diagram of the structure of dual resistances of the present invention

As another embodiment, refer to FIG. 4 and FIG. 5, in this embodiment, a connecting slot 22 is set in the ring-shaped connecting part A21. The ring-shaped connecting part B 121 is a ring-shaped protrusion part set outside the opening end of the outer bulb shell 12. The ring-shaped protrusion part is adaptive to the connecting slot 22. In this embodiment, connecting parts in the last embodiment are reversely set, so that the effect of quickly assembling the bulb may be achieved. The ring-shaped protrusion part and the connecting slot 22 may be also connected by clamping, ultrasonic welding, bonding or the like.

In the technical solution, the rubber base 2 is integrally formed with an inner bulb shell 23. The inner bulb shell 23 is embedded into the outer bulb shell 12. The stem assembly 13 extends into the inner bulb shell 23. The inner bulb shell and the outer bulb shell 12 which are nested with each other can improve the decoration effect of the lamp, and further can protect the stem assembly 13, so that the service life of the lamp is prolonged, and the applicable range of the lamp is extended.

Preferably, the inner bulb shell 23 is in the shape of a long strip convenient to mount. In the technical solution, the inner bulb shell 23 and the outer bulb shell 12 are nested with each other. The maximum diameter of the inner bulb shell 23 is smaller than an opening diameter of the outer bulb shell 12, so as to implement mounting. Therefore, the inventor sets the inner bulb shell 23 to be in a shape of a long strip to facilitate mounting, so that large-scale production is adapted and production efficiency can be greatly improved.

Figure 13:
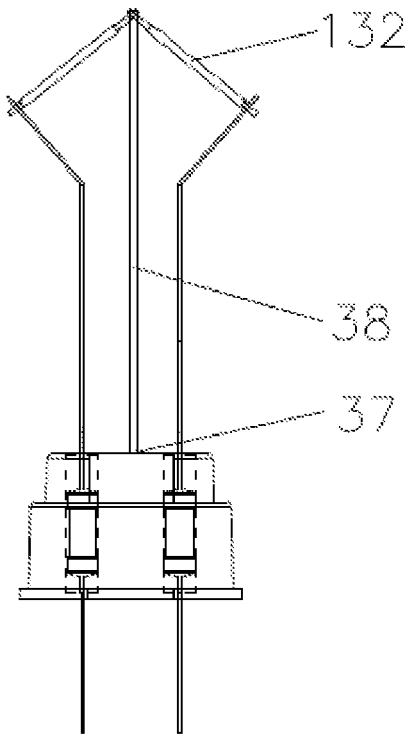
FIG. 13 is a structural diagram of the structure of dual light bars in a technical solution of the present invention.

In the present invention, the stem assembly 13 includes a first metal support line 131, an LED light bar 132 and a second metal support line 133 which are electrically connected in sequence. The first metal support line 131 includes a resistor A 1311. Both the first metal support line 131 and the second metal support line 133 are electrically connected to the LED lamp holder 11. The first metal support line 131 and the second metal support line 133 are used for conduction, and forms an electric loop together with the LED light bar 132, so that the light bar 132 can be used normally. The resistor A 1311 is used to prevent the light bar 132 from being burnt due to excessive current of the light bar 132. In the technical solution, a quantity of the LED light bars 132 can be increased according to a practical condition. FIG. 13 is an embodiment of the technical solution of dual light bars.

To further optimize the technical solution, the second metal support line 133 includes a resistor B 1331. One end of the resistor B 1331 is electrically connected to the first metal support line 131, and the other end of the resistor B is electrically connected to the LED lamp holder 11. Relative to heating of single resistance, dual resistances achieve better heat dissipation, so that the performance of the lamp is better. It may be further noted that, when a single resistance solution is adopted, the solution is not shown in the figure, and only one resistance is used based on the figure.

In the embodiment, the stem assembly 13 further includes a sealing rubber base 3 with an elastic waterproof sealing effect. The sealing rubber base 3 is in sealing close fit to the inner side of the mouth part of the rubber base 2. At least two sealing holes 31 for accommodating the resistor A 1311 and the resistor B 1331 are set in the sealing rubber base 3. To achieve the embodiment of dual light bars, one more jack 37 only needs to set in the sealing rubber base 3, and on more supporting column 38 is inserted into the jack 37.

Figure 9:
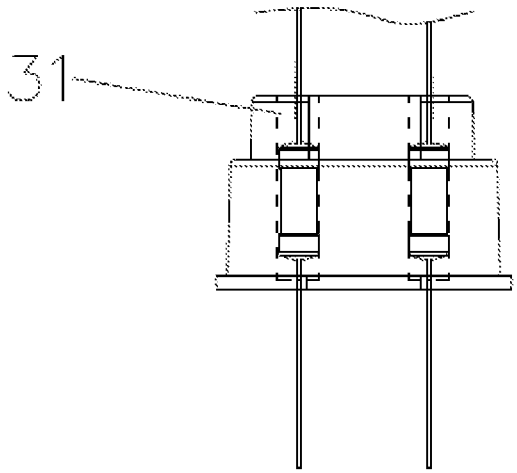
FIG. 9 is a structural diagram of the structure of a sealing rubber base of the present invention.

The sealing holes 31 are set in two embodiments. When the opening ends of the sealing holes 31 are positioned inside the mouth part of the rubber base 2, bottoms of the sealing holes 31 are positioned inside the mouth part of the inner bulb shell 23. As shown in FIG. 9, the technical effect of sealing and water-preventing can be implemented.

Figure 11:
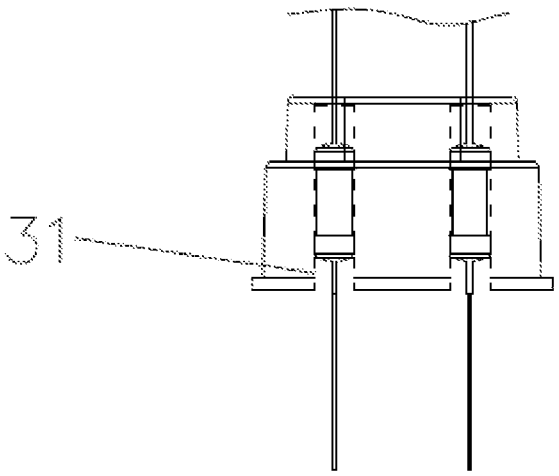
FIG. 11 is a schematic diagram of the structure of the sealing rubber base in another embodiment of the present invention.

In another embodiment, as shown in FIG. 11, when the opening ends of the sealing holes 31 are positioned outside the mouth part of the rubber base 2, bottoms of the sealing holes 31 are positioned inside the mouth part of the rubber base 2. This reverse setting manner also can implement the technical effect of sealing and water-preventing. The difference from the last embodiment is that: the direction of the sealing holes 31 in this embodiment is completely reverse to that of the sealing holes in the last embodiment. This structure further features the following advantages: the openings of the sealing holes 31 are set outside the mouth part of the rubber base 2, and therefore, the resistance corresponds to the inside of the LED lamp holder 11 after being mounted, and the LED lamp holder 11 will inevitably has a little water inlet phenomenon. When the resistance works, certain heat is generated, so that the temperature inside the LED lamp holder 11 can be increased, and water-discharging and moisture-exhausting effects are improved.

In the technical solution, the sealing rubber base 3 includes a cylindrical part 32 for water-preventing and sealing. The upper part of the cylindrical part 32 is connected to a supporting part 33, and a flange 34 is set on the lower part of the cylindrical part 32. The cylindrical part 32 and the mouth part of the rubber base 2 are sealed. The flange 34 is used to cover the mouth part of the rubber base 2, so that sealing performance is improved.

Preferably, a groove 35 is set in the outer end surface of the sealing rubber base 3. The groove 35 is perpendicular to the axes of the sealing holes 31. At least a part of section areas of the sealing holes 31 is correspondingly overlapped in the groove 35. The groove 35 features the following technical advantages: firstly, in case of distributing the sealing holes 31 to form an interior space, the structural thickness of the end surface is increased; secondly, positioning of circumference is facilitated while the resistance is automatically assembled; and thirdly, an extending conducting wire connected to the resistor A 1311 or the resistor 3 is limited to guide out from the outer end of the groove 35, so that this extending conducting wire is prevented from getting close to or being in contact with another extending conducting wire during a spiral assembly process.

Figure 10:
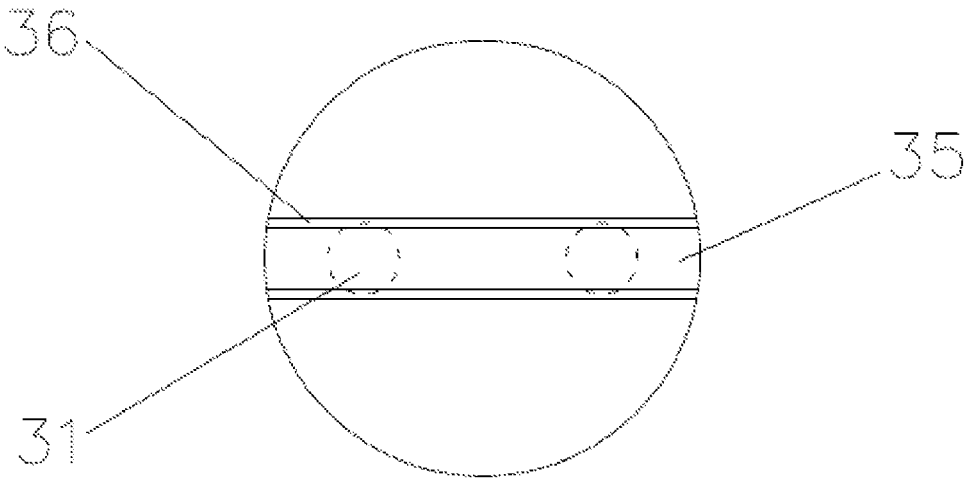
FIG. 10 is a structural diagram of the structure of a sealing hole of the present invention.
Figure 12:
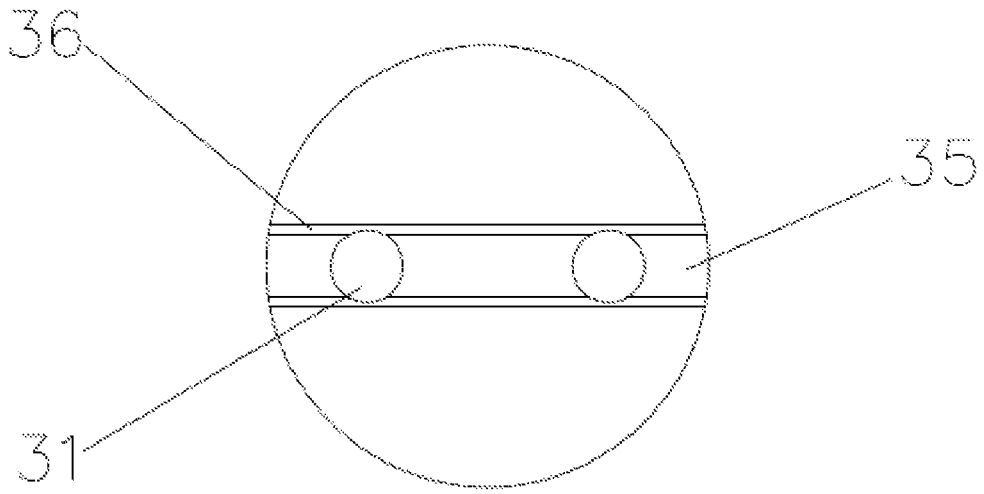
FIG. 12 is a structural diagram of the structure of the sealing hole in another embodiment of the present invention.

As shown in FIG. 10 and FIG. 12, raised bars 36 are set at the two sides of the groove 35. The raised bars 36 are raised out of the outer end surface of the sealing rubber base 3. According to a practical test, the raised height is preferably 1-2 mm. It is certain that the height can be increased based on the diameter increase of the lamp. In this way, the structure is optimized better and the assembly efficiency is improved.

The above content is only a preferred embodiment of the present invention, and those skilled in the art may make a change in the specific embodiment and the range of application according to the idea of the present invention. The content of the present invention should not be construed as a limit to the present invention.

What is claimed is:

1. An LED lamp with improved lamp holder structure, comprising: an LED lamp bulb, wherein the LED lamp bulb comprises an LED lamp holder, a stem assembly, and a plastic formed outer bulb shell; the stem assembly is connected to the LED lamp holder and extends into the plastic formed outer bulb shell; the LED lamp holder is connected to a rubber base, a ring-shaped connecting part A is set on the rubber base, a ring-shaped connecting part B is set on the plastic formed outer bulb shell, and the ring-shaped connecting part A is fixedly connected to the ring-shaped connecting part B;

wherein the stem assembly comprises a first metal support line, an LED light bar, and a second metal support line; the first metal support line, the LED light bar, and the second metal support line are electrically connected in sequence; the first metal support line comprises a resistor A; and both the first metal support line and the second metal support line are electrically connected to the LED lamp holder;

wherein the second metal support line comprises a resistor B, one end of the resistor B is electrically connected to the first metal support line, and the other end of the resistor B is electrically connected to the LED lamp holder.

2. The LED lamp with improved lamp holder structure according to claim 1, wherein the ring-shaped connecting part A is a ring-shaped protrusion part, the ring-shaped connecting part B is a ring-shaped platform part set inside the opening end of the plastic formed outer bulb shell, and the ring-shaped protrusion part abuts against the ring-shaped platform part.

3. The LED lamp with improved lamp holder structure according to claim 1, wherein a connecting slot is set in the ring-shaped connecting part A, the ring-shaped connecting part B is a ring-shaped protrusion part set outside the opening end of the plastic formed outer bulb shell, and the ring-shaped protrusion part is adaptive to the connecting slot.

4. The LED lamp with improved lamp holder structure according to claim 1, wherein the rubber base is integrally formed with an inner bulb shell, the inner bulb shell is embedded into the plastic formed outer bulb shell, and the stem assembly extends into the inner bulb shell.

5. The LED lamp with improved lamp holder structure according to claim 1, wherein the stem assembly further comprises a sealing rubber base with an elastic waterproof sealing effect, the sealing rubber base is in sealing close fit to the inner side of a mouth part of the rubber base; and at least two sealing holes for accommodating the resistor A and the resistor B are set in the sealing rubber base.

6. The LED lamp with improved lamp holder structure according to claim 5, wherein opening ends of the sealing holes are positioned inside the mouth part of the rubber base, and bottoms of the sealing holes are positioned outside the mouth part of the rubber base; or the opening ends of the sealing holes are positioned outside the mouth part of the rubber base, and bottoms of the sealing holes are positioned inside the mouth part of the rubber base.

7. The LED lamp with improved lamp holder structure according to claim 5, wherein the sealing rubber base comprises a cylindrical part for water-preventing and sealing, the upper part of the cylindrical part is connected to a supporting part, and a flange is set on the lower part of the cylindrical part.

8. The LED lamp with improved lamp holder structure according to claim 5, wherein a groove is set in the outer end surface of the sealing rubber base, the groove is perpendicular to axes of the sealing holes, and at least a part of section areas of the sealing holes is correspondingly overlapped in the groove.

* * * * *